US005104267A

United States Patent [19]

Lagodka et al.

[11] Patent Number: 5,104,267

[45] Date of Patent: Apr. 14, 1992

[54] ROOF SUPPORTS FOR A MINING INSTALLATION

[75] Inventors: Günter Lagodka; Fritz Kleibohmer; Ulrich Hilker, all of Lunen, Fed. Rep. of Germany

[73] Assignee: Gewerkschaft Eisenhutte Westfalia GmbH, Fed. Rep. of Germany

[21] Appl. No.: 622,926

[22] Filed: Dec. 6, 1990

[30] Foreign Application Priority Data

Dec. 9, 1989 [DE] Fed. Rep. of Germany ..... 3940818

[51] Int. Cl.[5] ..... C21D 23/00

[52] U.S. Cl. ..... 405/296; 299/33

[58] Field of Search ..... 405/291, 296; 299/33

[56] References Cited

U.S. PATENT DOCUMENTS 4,386,878 6/1983 Martinko et al. ..... 405/291
4,560,306 12/1985 Murfitt ..... 405/291

FOREIGN PATENT DOCUMENTS 3107955 11/1983 Fed. Rep. of Germany .
3727650 3/1989 Fed. Rep. of Germany .
620631 8/1978 U.S.S.R. ..... 299/33
1084457 4/1984 U.S.S.R. ..... 405/296
1184949 10/1985 U.S.S.R. ..... 405/296
2096680 10/1982 United Kingdom ..... 405/296

OTHER PUBLICATIONS

*Gluckauf* 9-1967, pp. 1015-1016.
*Gluckauf* 1985, p. 1282.

*Primary Examiner*—David J. Bagnell
*Attorney, Agent, or Firm*—Samuels, Gauthier & Stevens

[57] ABSTRACT

A mine roof support or lining frame for use in mine workings with thick inclined seams has hydraulic props mounted between an inclined goaf shield and a floor sill. The floor sill is coupled with a shifting mechanism to a frame supporting a conveyor extending along a working face of the seam. Mineral from a region of the seam extending over the support passes through an opening in the shield onto a chute which takes an inclined disposition parallel to the conveyor. Material transferred to the chute discharges in the direction of transport of the conveyor.

18 Claims, 2 Drawing Sheets

ROOF SUPPORTS FOR A MINING INSTALLATION

FIELD OF THE INVENTION

The present invention relates to mine roof supports and mineral mining installations employing such supports.

BACKGROUND TO THE INVENTION

Mine roof supports or lining frames composed of one or more hydraulic props disposed between roof bars and floor sills and goaf shields which extend between the roof bars and the floor sills and screen off the stowage zone of an underground longwall mine working are known in a variety of forms. Normally, the supports are mounted side-by-side along the working and alongside a mineral, e.g. coal, face and a conveyor, also extending along the working, serves to transport material detached from the face. Where the mine working contains a thick inclined seam of mineral deposit then an upper region of the seam extends over at least part of the roof. In order to collect the material from the upper region of the seam special measures are necessary: see, for example DE-PS-3107955, DE-OS-3727650 "Gluckauf" 28th September, 1967, P1015-1016 and "Gluckauf" 1985, P1282. Known supports or lining frames enable the working face of the seam to be mined in a conventional manner, e.g. with a shearer, and then permit material detached from the upper inclined roof region, by explosives or simply breaking off, to pass through openings into the main extraction space where it is guided with loading chutes onto the conveyor. The openings can be provided in the goaf shields of the supports which take a position inclined from roof bars to the floor sills of the supports. Each loading chute takes up a position where it inclines towards the working face. Where the seam is disposed at a steep angle, typically 15°-20°, than the discharge and loading performance is problematic. It is also known to have the chutes equipped with side plates or aprons. This causes more difficulties especially when the chutes are used to close off the openings by swinging the chutes upwardly against the shields. The chutes are comparatively long and have their pivot bearings at the stowage side of the shields. This tends to impede the extraction space.

A general object of the present invention is to provide an improved form of support usable in a variety of conditions and particularly where a seam deposit is inclined.

SUMMARY OF THE INVENTION

A support constructed in accordance with the invention has a loading chute beneath an opening in a goaf shield, as is known, but in contrast to the known arrangements the chute is inclined in the longitudinal direction of the working and the conveyor. Preferably, the chute is mounted for pivoting about an axis extending in the direction of advancement of the support and the angle of inclination is varied with a piston and cylinder unit. Material discharged from the chute flows in the longitudinal direction of material transported on the conveyor and not transverse as hitherto.

A relative smooth discharge of material from the upper roof region of the seam can take place via openings and chutes on supports disposed along the working.

The arrangement of the chute also enables the construction of the support to be simplified. The chute no longer has to be mounted on pivot joints at the stowage side of the support. On the contrary, the chute can be positioned nearer the face and further forward than the props. This reduces the overall length of the chute so it can be smaller in length than the width of the roof bar or canopy. The chute can thus be lighter in weight which aids assembly and adjustment. The chute can easily be adjusted with a small piston and cylinder unit at one side or the other of the opening in the shield. In the prior art designs, a large bulky unit supported on the floor sill of the support was necessary to adjust the chute.

Conveniently, the discharge opening for co-operating with the chute is positioned at the work face end zone of a goaf shield at which a roof bar or canopy is located. The shield is supported by one or more hydraulic props and connected to a floor sill with a guide linkage of known design. The roof bar can be fixed to the work face end of the inclined shield with a pivot joint or rigidly. The props are positioned nearer the stowage zone than the opening and the chute. The opening is preferable selectively closable with the aid of a slidably mounted plate supported on the shield and adjustable with a piston and cylinder unit.

The support is preferably connected via a shifting mechanism to a conveyor or to a floor frame supporting the conveyor. When the support is advanced up to the conveyor the conveyor is disposed more or less vertically beneath the opening and the discharge chute extending along the working. This enables the material passing down through the opening to flow along the chute and to discharge in the conveying direction.

To provide a more versatile arrangement, the shield can have brackets for the pivot joints of the chute at either side of the discharge opening so that the chute can slope in one direction or in the opposite direction. Similar brackets can be provided at either side of the opening to permit the piston and cylinder units used to adjust the chute also to be relocated.

The invention may be understood more readily, and various other aspects and features of the invention may become more apparent, from consideration of the following description.

BRIEF DESCRIPTION OF DRAWINGS

An embodiment of the invention will now be described by way of example only, with reference to the accompanying drawings wherein.

DESCRIPTION OF PREFERRED EMBODIMENT

Figure 1:
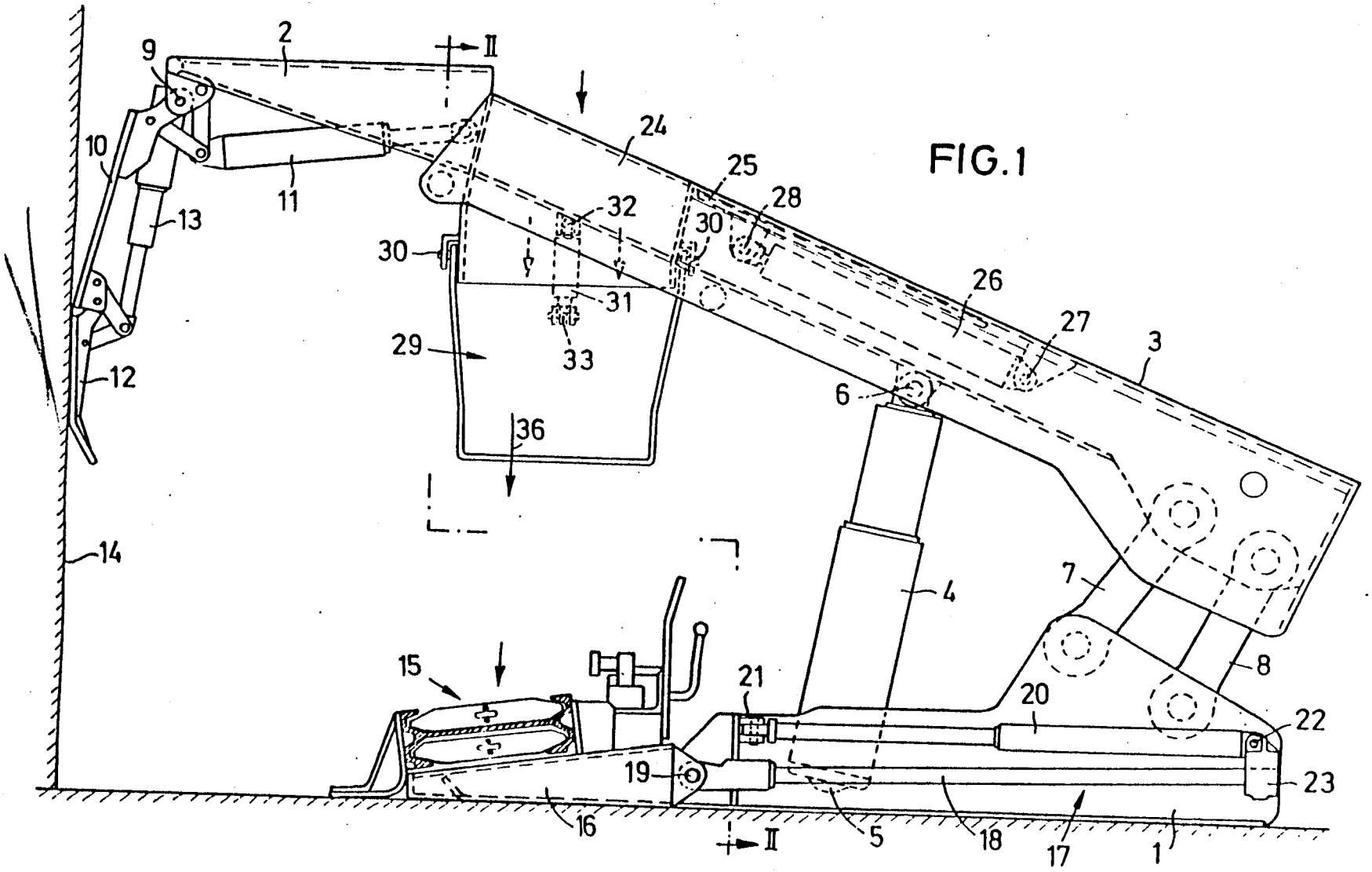
FIG. 1 is a schematic side view of a mineral mining installation and a roof support constructed in accordance with the invention.

As shown in the drawings, a support in an underground mine working is composed of a floor-engaging structure or sill 1, a roof-engaging structure or bar 2 and a shield 3 carrying the roof bar 2. The shield 3 takes an inclined disposition downwards from the roof bar 2 towards the floor and the goaf or stowage zone of the working. A pair of hydraulic props 4 are mounted with joints 5 to the floor structure 1 and with joints 6 to the shield 3. The shield 3 is connected at its stowage end to the floor structure 1 via links 7, 8 as is known, which act to guide the shield 3 as the props 4 are extended or retracted.

An auxillary bar 10 is connected with a pivot joint 9 to the roof bar 2 and an hydraulic piston and cylinder unit 11 is connected between the bars 10, 2 to effect adjustment of the bar 10. A further bar 12 acting as a shock absorber is pivotably connected to the bar 10 and an hydraulic piston and cylinder unit 13 is connected between the bars 10, 12 to effect adjustment of the bar 12. Assemblies of this type are known and, as shown, the bars 10, 12 can be adjusted to bear on a mineral, e.g. coal, face 14 which forms part of an inclined seam.

A scraper-chain conveyor 15 is composed of pans connected end-to-end along the working and a scraper-chain assembly circulating along the pans serves to transfer material stripped from the face 14 and also material discharged from the upper roof region of the seam.

The conveyor 15 is supported on a frame 16. A number of supports and frames as described and illustrated would be disposed side-by-side along the working and the frames 16 are each connected to a shifting mechanism 17 connected to the supports. The mechanisms 17 associated with the supports are composed of guide rods 18 connected with joints 19 to the frames 16 and double-acting hydraulic rams 20. The rams 20 have piston rods connected to the floor sills 1 with joints 21 and cylinders joined to connectors 23 with joints 22. The guide rods 18 are adjustably linked to the connectors 23 which are guided in relation to the floor sills 1.

In accordance with the invention, the shield 3 is provided with an opening 24, conveniently of rectangular form, in an end region adjacent the bar 2. With the support advanced up to the conveyor 15, by extension of the ram or rams 20 associated therewith the opening 24 is positioned more or less vertically above the conveyor 15. The opening 24 can be selectively closed by means of a slidable plate 25 guided on the shield 3. An hydraulic piston and cylinder unit 26 is used to adjust the closure plate 25. The unit 26 has its cylinder 25 coupled to the shield 3 with a joint 27 and its piston rod coupled to the plate 25 with a joint 28. FIG. 1 shows the plate 24 withdrawn towards the stowage zone to unclose the opening 24. When it is desired to close the opening 24 the unit 26 is extended to urge the plate 24 towards the bar 2.

Figure 2:
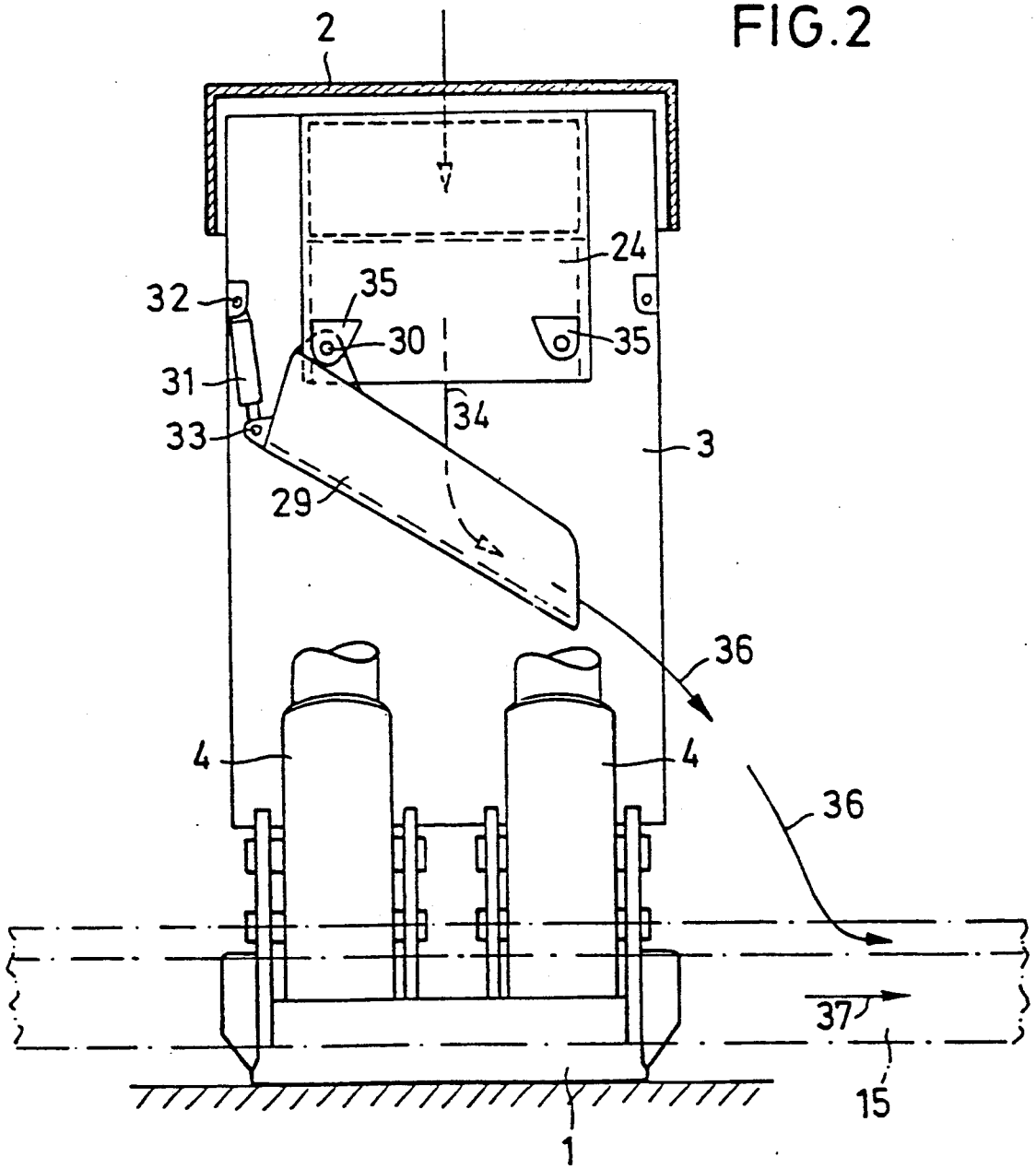
FIG. 2 is a part-sectional end view of the support shown in FIG. 1, the view being taken along the line II—II of FIG. 1.

A loading chute 29 extending parallel to the conveyor 15 is supported beneath the shield 3 on pivot joints 30 to guide material passing through the opening 24 onto the conveyor 15. The chute 29 is adjustable about the joints 30 to vary its inclination (FIG. 2) in a direction along the working and along the conveyor 15. To adjust the chute 29, an hydraulic piston and cylinder unit 31 is provided. The unit 31 has its cylinder connected to the shield 3 with a pivot joint 32 and its piston rod connected to the chute 29 with a pivot joint 33. The chute 29 has an overall length less than the width of the roof bar 2. FIGS. 1 and 2 depict the chute 29 in its operating position where material from the upper region of the inclined seam passes through the opening 24 and is deflected along the chute 29 to discharge onto the conveyor 15 as indicated by the arrows 36. The conveyor 15 transports the material along the working in the direction of arrow 37. The chute 29 can be adjusted about the joints 30 to suit the prevailing conditions. When the opening 24 is closed the chute 29 can be swung about the joints 30 against the underside of the shield 3.

As shown in FIG. 2, the shield 3 has brackets 35 on either side of the opening 24 to permit the chute 29 to be mounted with the pivot joints 30 on either side. Similarly. further brackets can be provided on the shield 3 for connecting the unit 31 with the pivot joint 32 in the alternative positions. If the chute 29 and the unit 31 is transposed from the position shown in FIG. 2 then the material discharged from the chute moves contrary to the arrows 36. Where the conveyor 15 reverses direction the chute 29 can thus be re-positioned to ensure the material always discharges in the prevailing transport direction.

The normal winning of mineral from the face 14 can occur with any conventional machinery such as a shearer. The material discharged through the openings 24 in the shields 3 of the supports from the upper region of the seam forming part of the roof supplements the material detached from the face 14. Where the material detached from the upper region is not completely loaded with the chutes 29 onto the conveyor 15 than material accumulating on the floor near the conveyor 15 can be collected in known manner, e.g. with the winning machine.

We claim:

1. In a mineral mining installation with a conveyor extending alongside a working face on a mineral seam; a roof support comprising a floor-engaging structure, a roof-engaging structure, an inclined shield extending between the roof and floor engaging structures, an opening for permitting material to pass from a roof portion of the seam to the conveyor and an inclined loading chute extending generally parallel to the longitudinal direction of the conveyor for guiding the material passing through the opening onto the conveyor wherein the chute is mounted for pivoting about an axis transverse to a longitudinal axis of the conveyor.

2. A support according to claim 1, and further comprising means for adjusting the pivotal position of the chute about said axis.

3. A support according to claim 2, wherein one or more hydraulic props are mounted between the shield and the floor-engaging structure and the props are disposed remote from the working face relative to the opening. .

4. A support according to claim 1 wherein the opening is provided in an end zone of the shield near the roof engaging structure.

5. A support according to claim 4, wherein the opening is selectively closable with the aid of a plate mounted for slidably displacement on the shield.

6. A support according to claim 5, wherein the plate is adjustable to open or close the opening wit a piston and cylinder unit.

7. A support according to claim 4, wherein the chute is mounted for pivoting on the shield about an axis extending transversally of the conveyor and the shield has several connections permitting the chute to be mounted in alternative pivotable dispositions.

8. A support according to claim 7 and further comprising a piston and cylinder unit for swinging the chute about a pivot axis extending transverse to the conveyor, the unit being connectable with a pivot joint to one of several connections on the shield in the alternative dispositions of the chute.

9. A support according to claim 1, wherein the shield is connected to the floor engaging structure via a guide linkage.

10. A support according to claim 1, wherein the roof-engaging structure is a separate roof bar connected to the end of the shield nearest the working face.

11. A support according to claim 10 wherein at least one further bar is connected to the roof bar and is engageable with the working face.

12. A support according to claim 11, and further comprising a piston and cylinder unit for adjusting the further bar in relation to the roof bar.

13. A support according to claim 1, wherein the opening is closable with an adjustable plate.

14. A support according to claim 1, wherein the length of the chute is less than the width of the roof-engaging structure in direction along the working.

15. A support according to claim 1, wherein a shifting mechanism is provided to advance the support towards the conveyor and the arrangement is such that when the support is fully advanced the conveyor lies vertically beneath the chute and the opening.

16. In a mineral mining installation with a conveyor extending alongside a working face of a mineral seam; a roof support comprising a floor-engaging structure, a roof-engaging structure, an inclined shield extending between the roof and floor engaging structures, an opening for permitting material to pass from a roof portion of the seam to the conveyor and inclined loading chute extending generally parallel to the longitudinal direction of the conveyor for guiding the material passing through the opening onto the conveyor wherein the chute is mounted for pivoting on the shield about an axis extending transversely of the conveyor, the shield has several connections permitting the chute to be mounted in alternative pivotable dispositions and the opening is provided in an end zone of the shield near the roof engaging structure.

17. In a mineral installation with a conveyor extending alongside a working face of a mineral seam; a roof support comprising a floor-engaging structure, a roof-engaging structure, an inclined shield extending between the roof and floor engaging structures, an opening for permitting material to pass from a roof portion of the seam to the conveyor and inclined loading chute extending generally parallel to the longitudinal direction of the conveyor for guiding the material passing through the opening onto the conveyor wherein the length of the chute is less than the width of the roof engaging structure in a direction along the working face.

18. In the mineral mining installation with a conveyor extending alongside a working face of a mineral seam; a roof support comprising a floor-engaging structure, a roof-engaging structure, an inclined shield extending between the roof and floor engaging structures, an opening in an end zone of the shield near the roof engaging structure for permitting material to pass from a roof portion of the seam to the conveyor and an inclined loading chute extending generally parallel to the longitudinal direction of the conveyor for guiding the material passing through the opening onto the conveyor, wherein the chute is mounted for pivoting on the shield about an axis extending transversely of the conveyor and the shield has several connections permitting the chute to be mounted in alternative pivotable dispositions and wherein there is provided a piston and cylinder unit for swinging the chute about a pivot axis extending transverse to the conveyor, the unit being connectable with a pivot joint to one of the several connections on the shield in the alternative dispositions of the chute.

* * * * *